US006665974B1

(12) United States Patent
Anderson

(10) Patent No.: US 6,665,974 B1
(45) Date of Patent: Dec. 23, 2003

(54) MOON CLIP CARTRIDGE LOADING DEVICE

(76) Inventor: Gordon K. Anderson, 14632 Pacific St., Tustin, CA (US) 92780

( * ) Notice: Subject to any disclaimer, the term of this patent is extended or adjusted under 35 U.S.C. 154(b) by 0 days.

(21) Appl. No.: 10/227,558

(22) Filed: Aug. 26, 2002

Related U.S. Application Data

(60) Provisional application No. 60/384,722, filed on Jun. 3, 2002.

(51) Int. Cl.[7] ..... F41A 9/82
(52) U.S. Cl. ..... 42/89
(58) Field of Search ..... 42/89, 87

(56) References Cited

U.S. PATENT DOCUMENTS

| | | | | | |
|---|---|---|---|---|---|
| 394,373 | A | * | 12/1888 | Kelton | 42/89 |
| 402,424 | A | * | 4/1889 | Ehbets | 42/89 |
| 1,181,034 | A | * | 4/1916 | Prideaux | 42/89 |
| 1,556,255 | A | * | 10/1925 | Silva | 42/89 |
| 2,637,930 | A | * | 5/1953 | Mason | 42/89 |
| 3,252,238 | A | * | 5/1966 | Bye | 42/89 |
| 3,769,732 | A | * | 11/1973 | Griffis | 42/89 |
| 4,437,252 | A | * | 3/1984 | Castellanos Manero | 42/89 |
| 4,535,558 | A | * | 8/1985 | Benesh | 42/89 |
| 5,083,393 | A | * | 1/1992 | Smydas | 42/90 |
| 5,261,178 | A | * | 11/1993 | Samish | 42/89 |

FOREIGN PATENT DOCUMENTS

| | | | | |
|---|---|---|---|---|
| DE | WO 94/12842 | * | 6/1994 | F41A/9/85 |

* cited by examiner

*Primary Examiner*—Michael J. Carone
*Assistant Examiner*—Denise J Buckley

(57) ABSTRACT

A loading device for insertion of cartridges into a revolver moon clip, which has a base (28') with a cylindrical post (56') in the center covered by an adapter sleeve (57). The adapter sleeve has a hexagonal shaped top that holds the moon clip in place. A number of loading levers (64') that have individual inwardly sloping radial cavities (82) are pivotally attached to the body and are disposed between a pair of upright guides (78) in the base. The levers are held in an open position allowing cartridges to be inserted into each of the cavities. After the cartridges are placed in the lever cavities and the moon clip is placed over the adapter sleeve the levers are manually compressed together in pairs snapping them into the recesses in the moon clip. The loaded clip is removed by lifting with the operators thumb and forefinger. A second embodiment functions in the same manner except the body (20) contains a series of inwardly sloping radial cavities (22) and a hexagonal post (56) is located in the center of the body with the loading levers (64) attached to the body in the middle of the inwardly sloping radial cavities.

19 Claims, 8 Drawing Sheets

MOON CLIP CARTRIDGE LOADING DEVICE

CROSS REFERENCE TO RELATED APPLICATION

This application claims priority of Provisional Patent Application Ser. No. 60/384,722 filed Jun. 3, 2002.

TECHNICAL FIELD

The present invention relates to cartridge loading devices in general. More specifically to a cartridge loader for moon clips used in revolvers.

BACKGROUND ART

Previously, many types of cartridge loading devices have been used in endeavoring to provide a quick and easy method of loading a cartridge in a clip used in operating a firearm. Most of the loaders were developed for the rapid loading of ammunition magazines for pistols and semi-automatic and automatic rifles.

DISCLOSURE OF THE INVENTION

The use of loading clips for revolvers employing rimless cases dates back to the First World War where half moon clips were developed to permit the use of .45 caliber automatic cartridges in contemporary revolvers such as produced by Colt and Smith and Wesson. This innovation relieved the shortage created by the demand for the newly developed Model 1911 semi-automatic pistol which employed a rimless cartridge case. These half moon clips have continued to be in successful use for similar firearms, however, a full moon clip was later introduced that functioned in the same manner but improved handling and simplified loading as only a single accessory was required.

The problem with both clips is the difficulty in loading cartridges when re-used by the civilian market. This difficulty is particularly apparent with the moon clip requiring manual dexterity for loading as it requires both hands, one of which must grasp the thin clip while the other forces the cartridge head recess into the mating grooves of the clip. The manual procedure is relatively simple, however if a number of clips are to be loaded the task becomes burdensome and is tiring to the hands. Furthermore the thin spring metal of the clip creates considerable operator discomfort when handling the sharp edges and recessed curves that are die cut into the clip.

A primary object of the invention is therefore directed to a tool that easily installs the cartridges by simply placing the clip on a hexagonal shaped post in the center of the tool and inserting the cartridges into mating grooves around the clip formed into the body or levers of the tool. The operator then grasps two opposed pivoting loading levers and squeezes them together until the cartridges snap into place. This procedure is duplicated with the other pairs of levers and the assembled clip is then removed by the operators thumb and forefinger.

An important object of the invention is the universal adaptation of the invention loading all bullet shapes and types of cartridges. The industry has increased the number of bullets available for pistol cartridges which may have relevance by changing their overall length. With a wide variety of bullets such as semi-wadcutters, hollow points, truncated metal jackets, hollow based wadcutters, round nosed and the original full metal jacket (hard ball), the length becomes an important factor in the design of the tool that ultimately depends on a defined length of cartridge. The present invention compensates for the varied length of the workpiece by replacing an adapter sleeve or by adding or removing spacers under the post that elevates or lowers the clip.

Another object of the invention is the simplicity of its construction in the second embodiment as the body is consists of injection molded parts that snap together and the levers are die cut and formed with a single bend to produce the finger tab. Conventional spring pins and springs along with a capscrew nut and coupling nut complete the assembly making the invention extremely simple and economical to produce. The preferred embodiment is even simpler in that only three basic individual injection molded parts are used with the loading arms also formed of thermoplastic and snapped into place on the body and an o-ring to hold the arms apart.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 17:
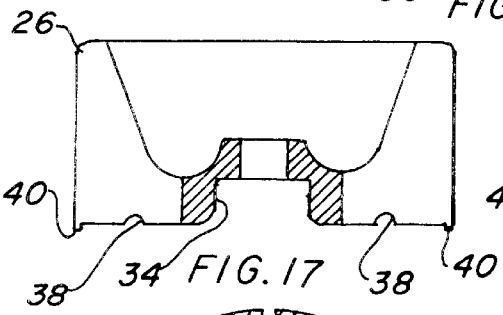
FIG. 17 is a cross-sectional view taken along lines 17—17 of FIG. 16.
Figure 18:
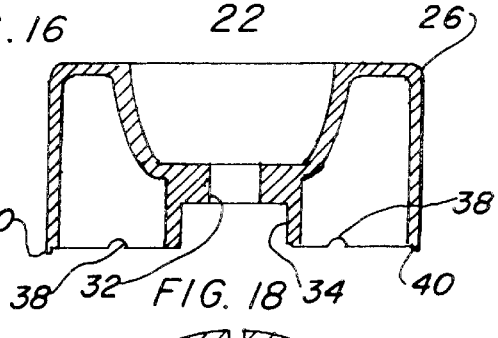
FIG. 18 is a cross-sectional view taken along lines 18—18 of FIG. 16.
Figure 19:
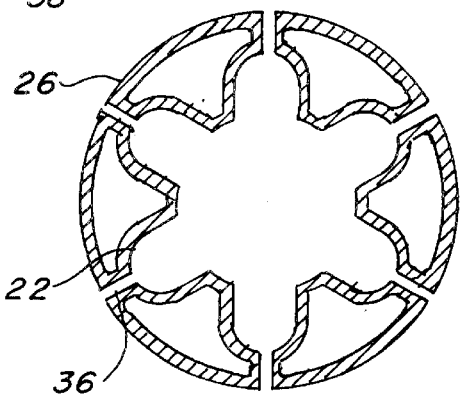
FIG. 19 is a cross-sectional view taken along lines 19—19 of FIG. 16.
Figure 20:
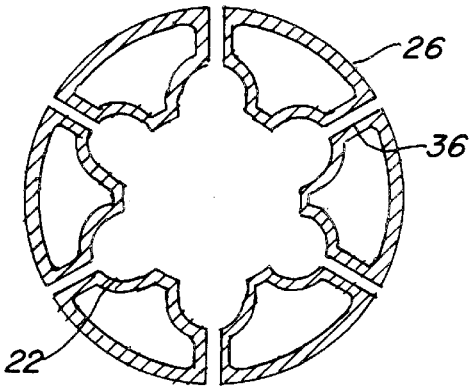
FIG. 20 is a cross-sectional view taken along lines 20—20 of FIG. 16.
Figure 21:
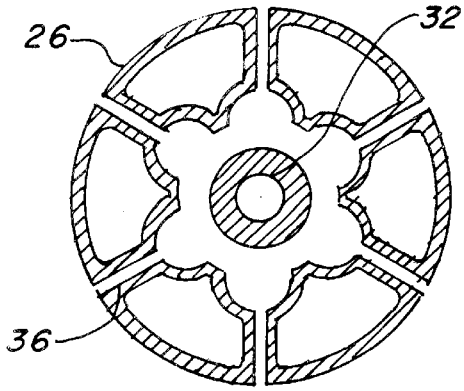
FIG. 21 is a cross-sectional view taken along lines 21—21 of FIG. 16.
Figure 22:
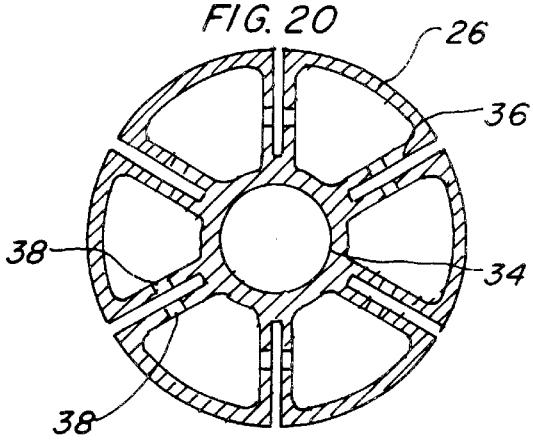
FIG. 22 is a cross-sectional view taken along lines 22—22 of FIG. 16.
Figure 24:
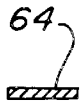
FIG. 24 is a cross-sectional view taken along lines 24—24 of FIG. 23.

The best mode for carrying out the invention is presented in terms of a preferred and a second embodiment. The second embodyment is shown in FIGS. 1 through 35 and is comprised of a cylindrical body 20 that includes a number of inwardly sloping radial cavities 22 that align with cartridge retaining notches on a moon clip 24. The number of cavities 22 is governed by the configuration of the moon clip 24 as this may vary from five to seven according to the revolver cylinder configuration however six is found to be the most common. The body 20 consists of an upper casing 26 and a base 28. FIGS. 16–22 illustrate the upper casing 26 while FIGS. 7–15 show the base in detail. Both the upper casing 26 and base 28 are preferably made of injection molded thermoplastic. Any type of thermoplastic material, even a thermosetting resin, may be used in this application including cellulose, polycarbonate, polyester, polyethylene, polystyrene, polyvinylchloride and the like, with ABS being preferred. The upper casing 26 is configured to include a platform 30 in the center joining all of the cavities 22 together, as shown in FIGS. 17 and 18 and a round aperture 32 is located in the exact center. Directly beneath the aperture 32 is a round recessed cavity 34 that is molded into the casing 26. A series of slots 36 are formed in the casing 26 directly in alignment with the cartridge retaining notches on the moon clip 24 and under the bottom of the slots 36 a semi-circular notch 38 is formed as illustrated in FIGS. 17 and 18. The casing 26 is essentially hollow to allow fabrication using the injection molding process and the slots 36 create lobes that are held together basically by the configuration of the platform in the middle. Finally, the casing 26 has a male flange with a protruding lip 40 on the bottom for attachment to the base 28.

Figure 1:
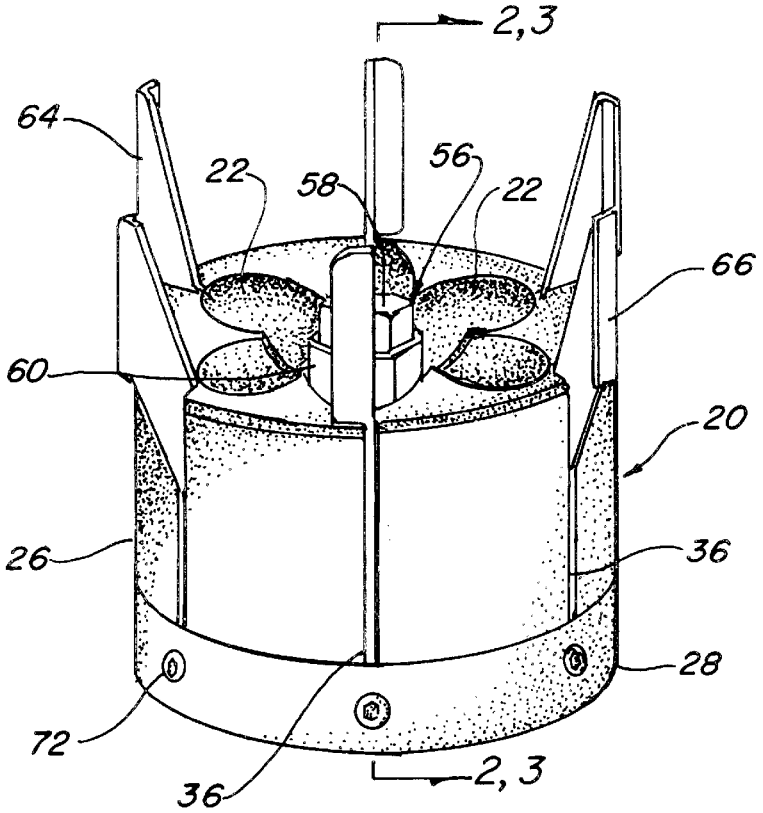
FIG. 1 is a partial isometric view of the second embodiment.
Figure 2:
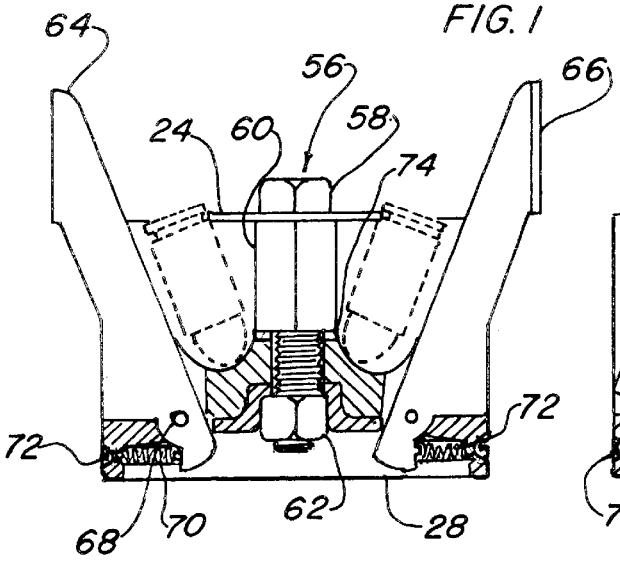
FIG. 2 is a cross sectional view taken along lines 2—2 of FIG. 1 with the moon clip in place and cartridges shown in dotted lines inserted in the loader with the actuating arms in the open at rest position.
Figure 3:
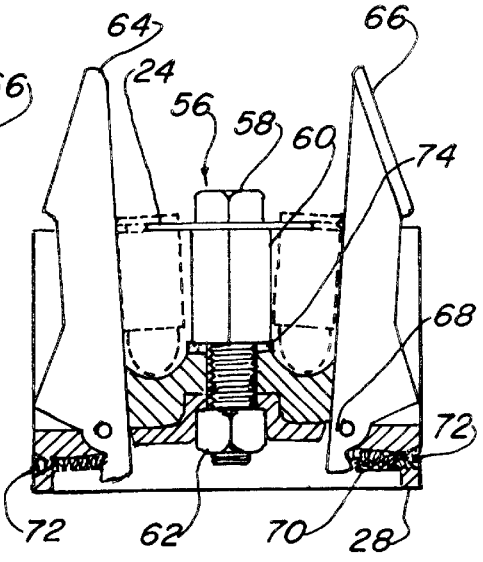
FIG. 3 is a cross sectional view taken along lines 3—3 of FIG. 1 with the moon clip in place and cartridges shown in dotted lines installed in the moon clip and the actuating arms in the manually closed position.
Figure 4:
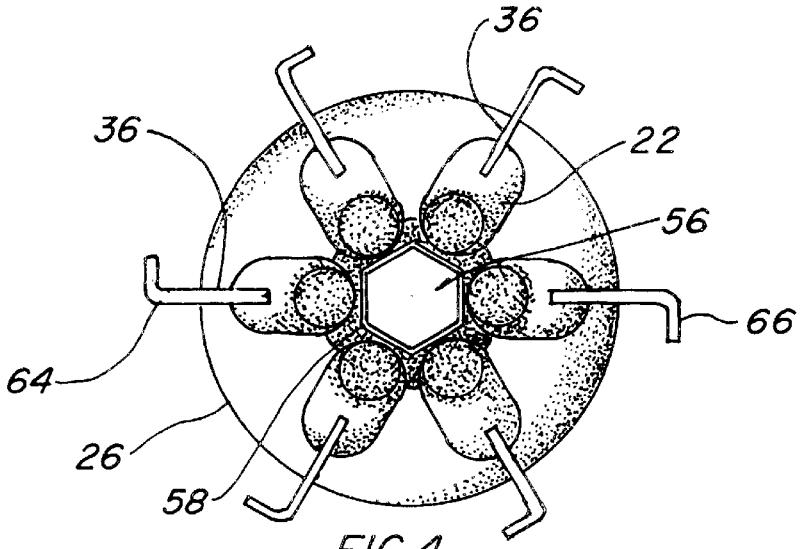
FIG. 4 is a plan view of the second embodiment.
Figure 5:
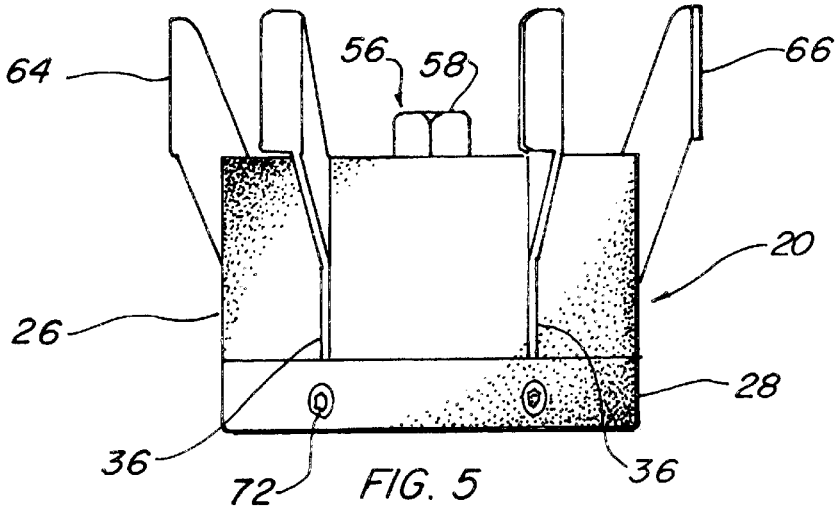
FIG. 5 is a front view of the second embodiment.
Figure 6:
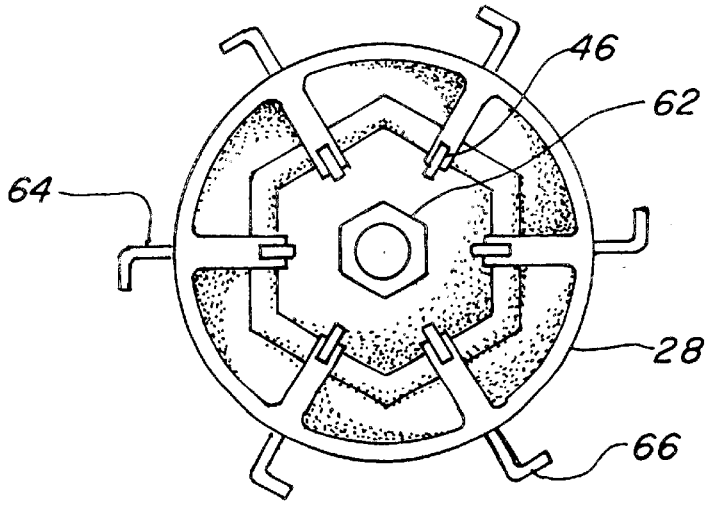
FIG. 6 is a bottom view of the second embodiment.
Figure 7:
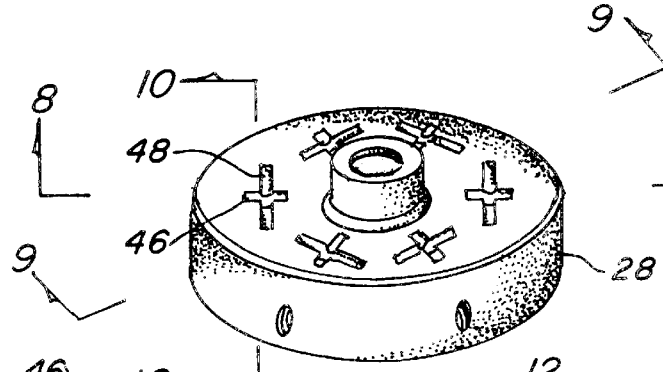
FIG. 7 is a partial isometric view of the body base completely removed from the invention for clarity.
Figure 8:
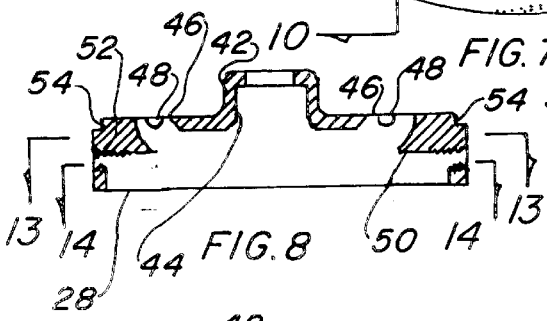
FIG. 8 is a cross-sectional view taken along lines 8—8 of FIG. 7.
Figure 9:
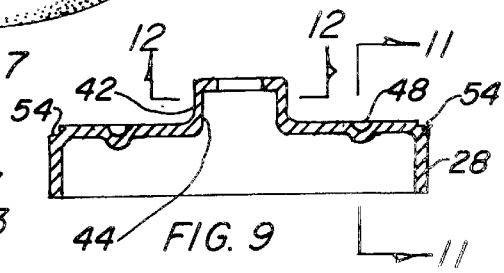
FIG. 9 is a cross-sectional view taken along lines 9—9 of FIG. 7.
Figure 10:
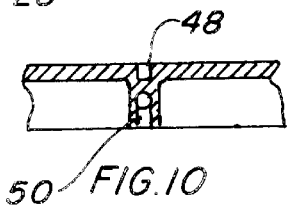
FIG. 10 is a cross-sectional view taken along lines 10—10 of FIG. 7
Figure 12:
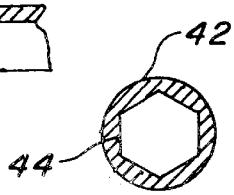
FIG. 12 is a cross-sectional view taken along lines 12—12 of FIG. 9.
Figure 13:
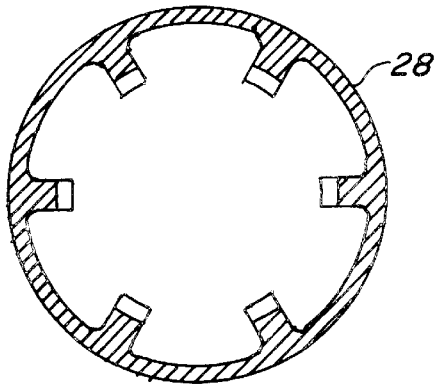
FIG. 13 is a cross-sectional view taken along lines 13—13 of FIG. 8.
Figure 11:
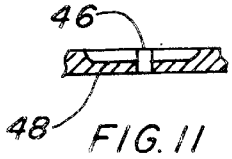
FIG. 11 is a cross-sectional view taken along lines 11—11 of FIG. 9.
Figure 14:
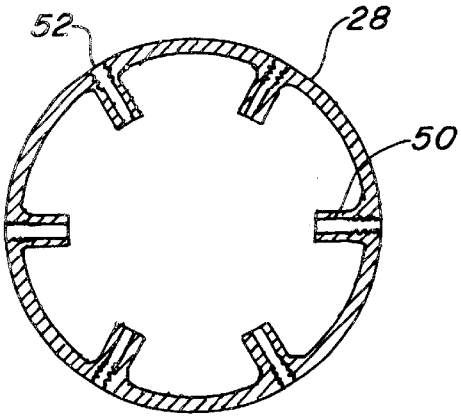
FIG. 14 is a cross-sectional view taken along lines 14—14 of FIG. 8.
Figure 15:
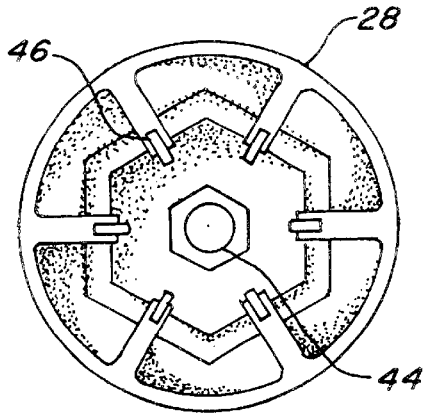
FIG. 15 is a bottom view of the base of the second embodiment completely removed from the invention for clarity.
Figure 16:
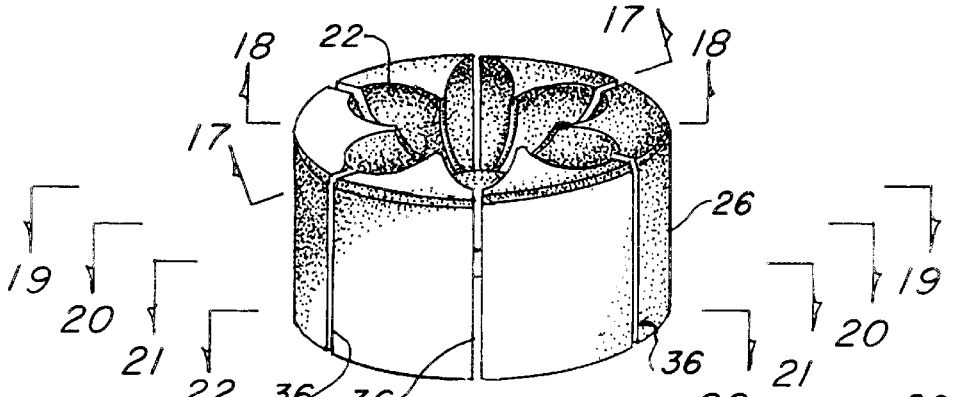
FIG. 16 is a partial isometric view of the body upper casing completely removed from the invention for clarity.

The base 28 is basically round and relatively flat and has a raised circular boss 42 in the center that is essentially the same size as the recessed cavity 34 of the casing 26 permitting them to nest together for correct alignment. The boss 42 also has a aperture 32 in the center that mates with its counterpart in the casing 26, as shown in FIGS. 2 and 3. A hexagonal cavity 44 is formed beneath the boss 42 and a number of rectangular slits 46 are positioned through the top flat surface of the base 28. An opposed pair of grooves 48 are located adjacent to the slits 46, as depicted in FIGS. 7–9 and 11, which mate with the notches 38 in the casing 26 forming a round hole when attached together. A spring retaining cavity 50 having a through bore 52 to the outside surface of the base is located in alignment with the slits 46 both of which are aligned with the slots 36 in the casing 26 when the casing and base are attached together. A female flange 54 is formed in the outside periphery of the base 28 as illustrated in FIGS. 8 and 9 and snaps together with the male flange 40 of the casing 26 to assemble the body 20 together. It should be noted however, that there are many other methods of attaching the body 20 such as a tongue and groove type connection or a raised rib on the boss 42 snapping into a groove in a recessed cavity or simply bonding the two pieces together with adhesive.

Post means in the form of a singular hexagonal post 56 is disposed uprightly within the body 20 in a central position, for holding the moon clip 24 thereon. The hexagonal post 56 is preferably made using a conventional a hex head cap screw 58 having dimensions that permits the moon clip 24 to slip over the top and position it relative to the slots 36. A coupling nut 60 is threaded all the way onto the cap screw 58 as shown in FIGS. 2 and 3 with the two forming the post 56. The coupling nut 60 has dimensions that are slightly larger than the cap screw 58, permitting the clip 24 to rest on the top of the coupling nut 60 while being retaining by the cap screw 58. Fastening means for attaching the hexagonal post 56 to the body 20 is in the form of a hex nut 62 that is pressed into the hexagonal cavity 44 of the base 28 which restrains the nut 62 from rotating due to its shape which is a close fit to the nut. It should also be realized that the post 56 may be made as an integral part of the body 20 as it is injection molded and could be easily formed as an integral part.

Figure 23:
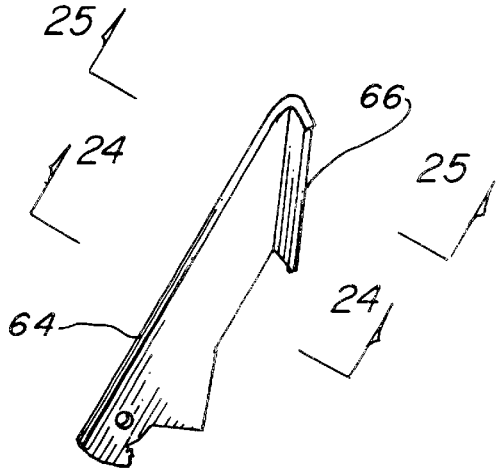
FIG. 23 is a partial isometric view of the pivotal loading arm completely removed from the invention for clarity.
Figure 25:
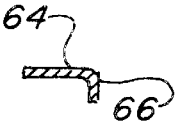
FIG. 25 is a cross-sectional view taken along lines 25—25 of FIG. 23.
Figure 26:
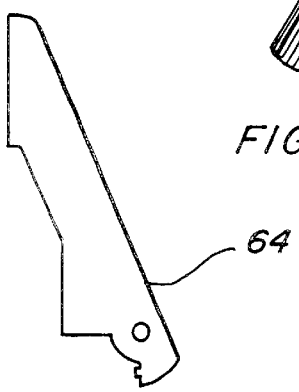
FIG. 26 is a right side view of the pivotal loading arm completely removed from the invention for clarity.
Figure 27:
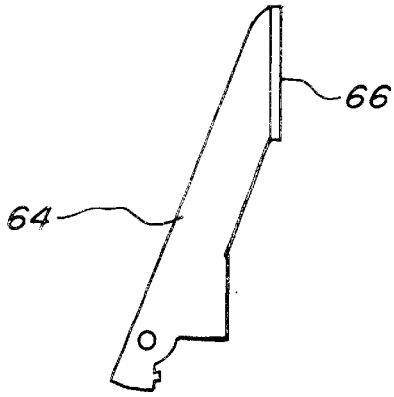
FIG. 27 is a left side view of the pivotal loading arm completely removed from the invention for clarity.
Figure 28:
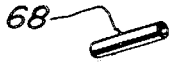
FIG. 28 is a partial isometric view of the spring pin completely removed from the invention for clarity.
Figure 29:
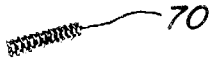
FIG. 29 is a partial isometric view of the compression spring completely removed from the invention for clarity.
Figure 30:
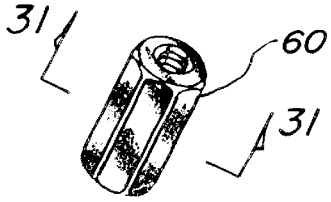
FIG. 30 is a partial isometric view of the coupling nut completely removed from the invention for clarity.
Figure 31:
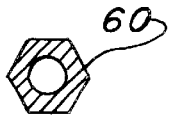
FIG. 31 is a cross-sectional view taken along lines 31—31 of FIG. 30.
Figure 32:
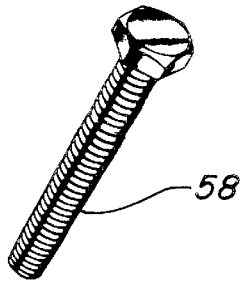
FIG. 32 is a partial isometric view of the hex head capscrew completely removed from the invention for clarity.
Figure 33:
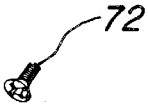
FIG. 33 is a partial isometric view of the self tapping screw completely removed from the invention for clarity.
Figure 34:
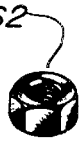
FIG. 34 is a partial isometric view of the hex nut completely removed from the invention for clarity.
Figure 35:
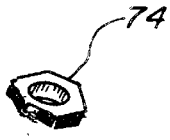
FIG. 35 is a partial isometric view of the hex spacer completely removed from the invention for clarity.
Figure 36:
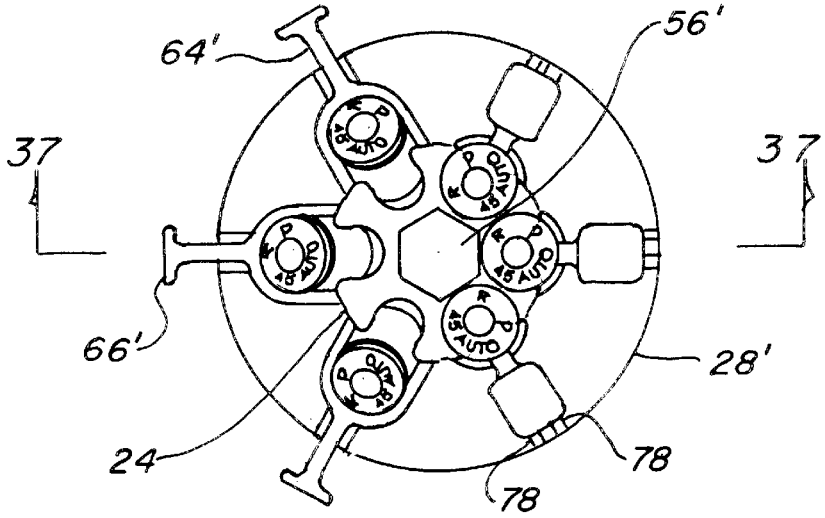
FIG. 36 is a top view of the preferred embodiment with the loading arms on the right shown in the closed position and the three on the left shown open.

A plurality of loading levers 64 pivotally engage the body 20 and are positioned in the middle of the sloping radial cavities 22. The levers 64 urge the cartridges into the moon clip 24 at each of its retaining notches when the levers 64 are manually compressing together in pairs. The loading levers 64 are preferably made of sheet metal which is die cut and formed with a single bend to produce the finger tab 66 as shown in FIGS. 23–27. The finger tab 66 is bent into an upper portion of the lever 64 and is used for manual manipulation as the levers are squeezed together by the users thumb and forefinger. A dowel or spring pin 68, depicted by itself in FIG. 28, is pressed into the lever 64, as shown in FIG. 23, for pivotal attachment to the body 20 which is illustrated in cross section of FIGS. 2 and 3.

Means are provided for holding the pivotal loading levers 64 in an expanded open position thereby permitting ease introduction of the cartridges into the radial cavities 22 prior to insertion of the cartridges into the moon clip 24 and are in the form of a compression spring 70 that is positioned between each lever 64 and the body 20 such that each lever is urged outwardly in an at rest position and the spring 70 is further compressed when the levers are manually squeezed together in pairs. The spring 70 is held in place with a protrusion on the lever 64 on one end and a self tapping screw 72 on the other end as shown in FIGS. 2 and 3. The screw 72 is threaded into a hole in the base 28 and may be the countersunk or round head type.

In order to accommodate a specific cartridge length at least one hex spacer 74 is positioned between the post 56 and the body 20 for height adjustment. One spacer 74 is shown in FIG. 2 however any number of spacers 74 may be used which simply raises the moon clip 24 up relative to the cavity 34. The post 56 is readily removed using a conventional wrench or socket on the cap screw 58 and the appropriate number of spacers 74 may be added or removed. The hex nut 62, under the post 56, is held in place by the hexagonal cavity 44 of the base 28 essentially captivating the nut thereby making the adjustment convenient and easy.

In operation individual cartridges are placed by hand into the cavity's 34 with the bullet end inserted first. The loading levers 64 are pressed together in pairs by the operator forcing the groove of the cartridge case just below the head into the indentations of the moon clip 24 with a snapping action. To remove the loaded clip the device may be turned upside down or preferably, the clip removed with the operators thumb and forefinger.

The preferred embodiment is illustrated in FIGS. 36 through 53 and operates in the same manner except it is simplified with only three primary elements used a body, an adapter sleeve and a plurality of levers. The body 20 consists basically of a base 28' and a adapter sleeve as shown in FIGS. 36, 37 and 47–53. The base 28' is molded of the same thermoplastic material as that of the second embodiment however its shape differs considerably as it includes post means in the form of a cylindrical post 56' as a integrally molded element that extends upwardly from the base 28' in the center. The base is hollow at the bottom forming a cavity to permit space for operating elements without extending beneath the outline of the base 28'.

Figures 47, 48, 49, 50, 51, 52, 53:
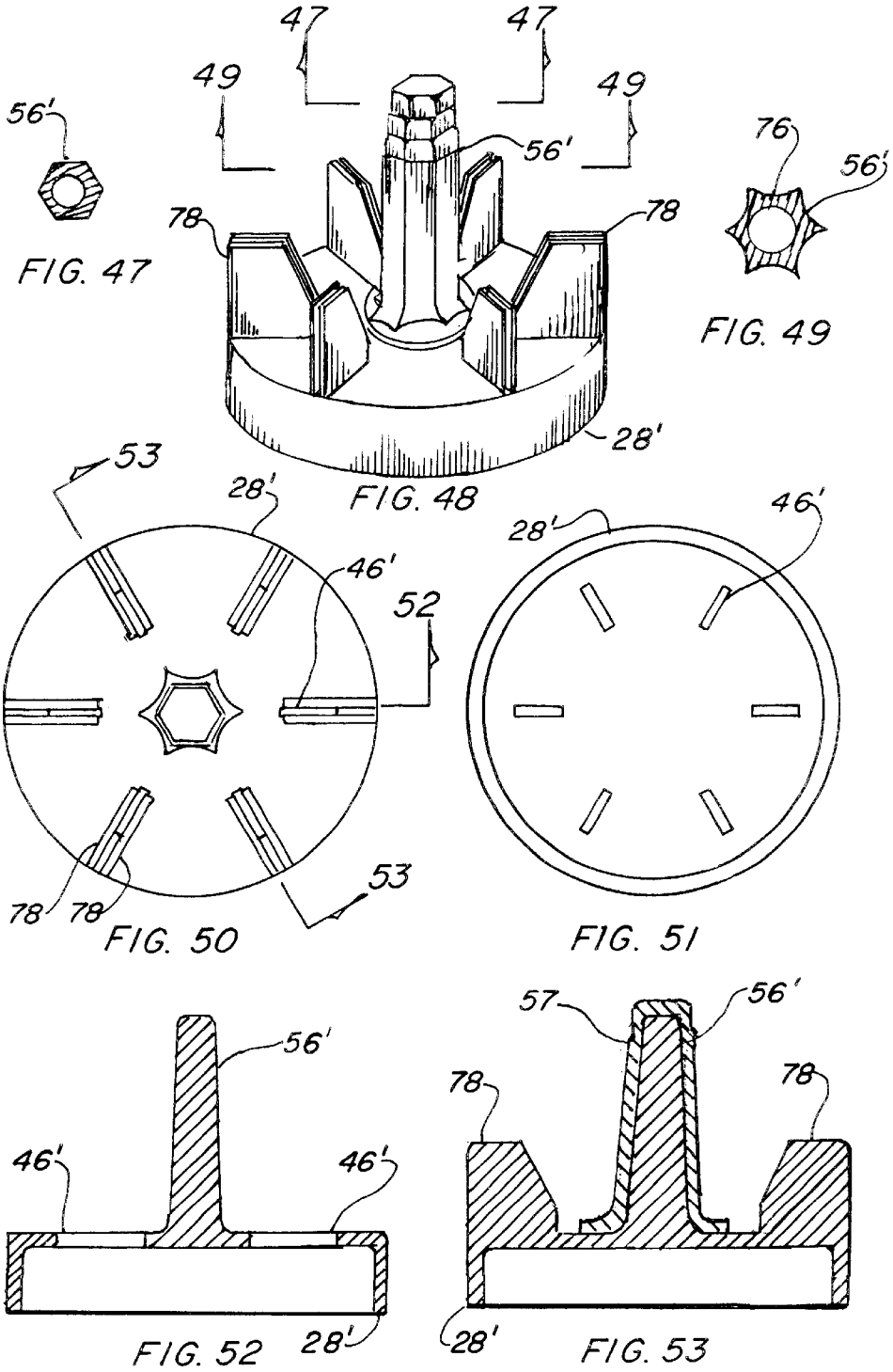
FIG. 47 is a cross-sectional view taken along lines 47–47 of FIG. 48.
FIG. 48 is a partial isometric view of the body base and adapter sleeve in the preferred embodiment completely removed from the invention for clarity.
FIG. 49 is a cross-sectional view taken along lines 49–49 of FIG. 48.
FIG. 50 is a top plan view of the body base and adapter sleeve in the preferred embodiment, completely removed from the invention for clarity.
FIG. 51 is a bottom view of the body base in the preferred embodiment, completely removed from the invention for clarity.
FIG. 52 is a cross-sectional view taken along lines 52—52 of FIG. 50 with the adapter sleeve removed.
FIG. 53 is a cross-sectional view taken along lines 53—53 of FIG. 50 with the adapter sleeve in place over the post.

Adjustment means for height regulation to accommodate a specific cartridge length is achieved by the use of the post means in the form of an adapter sleeve 57 which slips over the post 56' and is held in place with securement means in any number of forms well known in the art. The shape of the adapter sleeve 57 is also different than the second embodiment post 56 in that the lower portion is round on the inside but on the outside it is hexagonal or polygonal with each flat having an internal radius 76 as illustrated in FIG. 49. The top portion is basically the same as the second embodiment in shape with the top rounded slightly to accommodate installing the moon clip 24 on the sleeve. The most predominant difference with the second embodiment is that the upper end of the sleeve 57 is stepped to accommodate different configurations of moon clips as there are numerous styles and manufactures and the cartridges even for the same caliber utilize different bullets that have various lengths and shapes. In order to be adaptable to the most common styles it has been found that the upward distal end of the sleeve 57 may be stepped with the smallest size on the top as an example the 357 magnum cartridge for a six shot revolver is the first step with the 45 ACP cartridge moon clip the second step and the 10 millimeter magnum the third step as illustrated in the drawings. While the above moon clips are mostly hexagonal in their center by including a radius on the apexes of the angular portions a round center clip may be accommodated as well. It has been found that a separate and distinct adapter sleeve 57 may be furnished with the invention that would be sized for the different length of bullet in each caliber making the moon clip cartridge loading device almost universal by simply replacing the sleeve 57. It should be noted however that the configuration shown in the drawings and described above are not a limiting factor in the invention as the adapter sleeve 57 may be made in any form and size to accommodate a specific size of moon clip, numbers of cartridges utilized and the cartridge/bullet combination.

The underside of the base 28' is similar to the second embodiment including the slits 46' however the grooves 48, spring retaining cavity 50 and through bore 52 are omitted as illustrated best in FIGS. 52 and 53. A plurality of upright guides 78 are molded into the top portion of the base 28', one on each side of the loading levers 64', as shown in FIGS. 48 and 50. These guides 78 are spaced apart just enough to clear the levers 64' and permit them to move in an arc in between while maintaining alignment with the recesses on the moon clip 24. The slits 46' are also positioned in between the guides permitting the levers to penetrate thorough the base 28'.

The levers 64' in the preferred embodiment are somewhat different in that instead of being formed of die cut metal they are formed of injection molded thermoplastic of the same formulation as mentioned previously. The levers 64' are shown by themselves in FIGS. 40–46 and finger tab 66' distends from both sides of the lever rather than just one side as before. The biggest difference is that the levers include an integral inwardly sloping radial cavity 82 on the side opposite the tabs 66', for retaining cartridges thereon.

In order to arcuately mount the loading lever 64' onto the base 28' a metal dowel or spring pin 86 is pressed into a hole in the lever as depicted in FIGS. 40–43 as well as 45 and is snapped into the notched radial recesses 80 in the base 28' holding each levers securely in place yet permitting the necessary rotation required to forceably insert the cartridges in the clip.

The loading levers 64' are mounted to the base 28' by snapping them in place thorough these radial recesses 80 as shown in FIGS. 50–53. These recesses 80 are configured to grasp and hold each dowel or spring pin 86 by a snapping action while still permitting the lever 64' to rotate freely.

Figure 37:
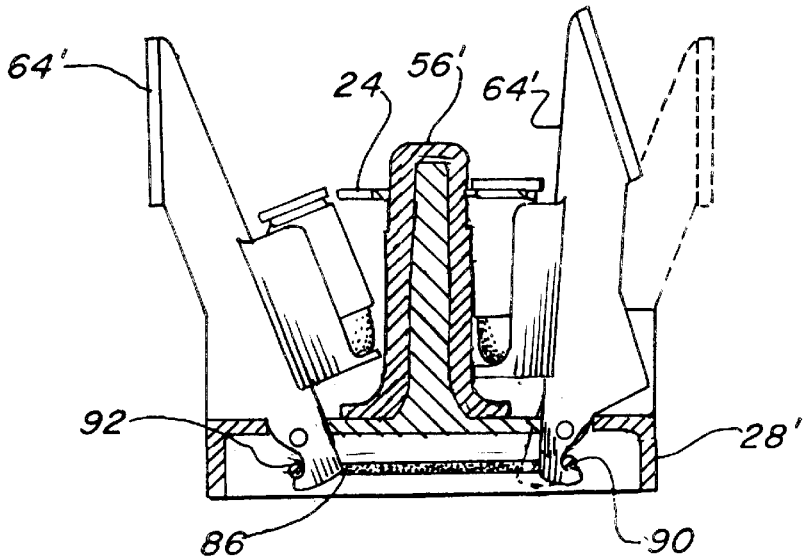
FIG. 37 is a cross-sectional view taken along lines 37—37 of FIG. 36 with the loading arms illustrated in both positions and dotted to show the relative movement.
Figure 38:
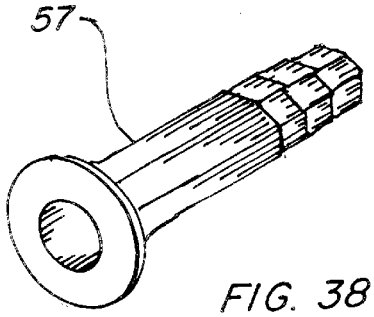
FIG. 38 is a partial isometric view of the adapter sleeve completely removed from the invention for clarity.
Figure 39:
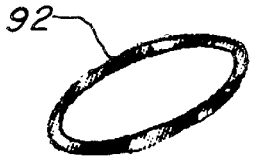
FIG. 39 is a partial isometric view of the o-ring completely removed from the invention for clarity.
Figure 40:
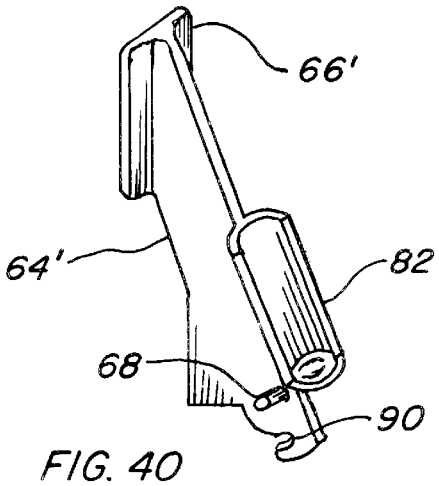
FIG. 40 is a partial isometric view of the pivotal loading arm in the second embodiment, completely removed from the invention for clarity.
Figure 41:
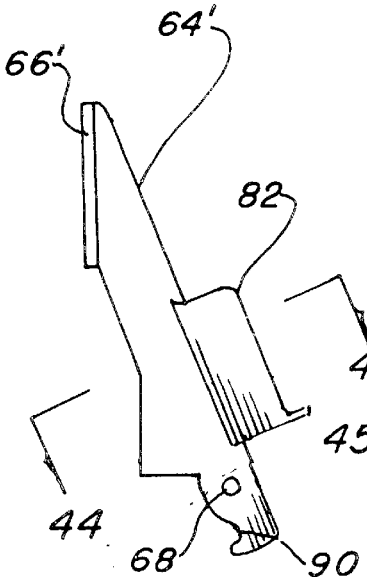
FIG. 41 is a left side view of the pivotal loading arm in the second embodiment, completely removed from the invention for clarity.
Figure 42:
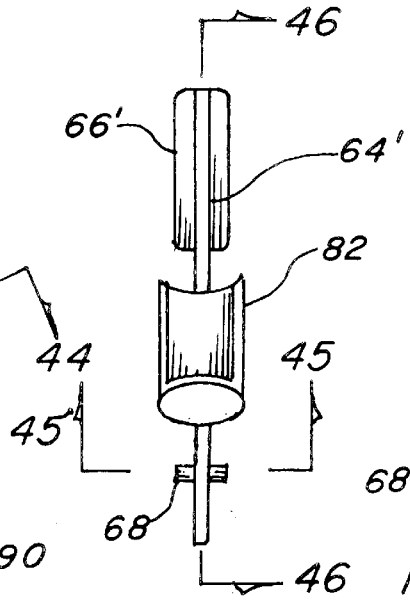
FIG. 42 is a front view of the pivotal loading arm in the preferred embodiment, completely removed from the invention for clarity.
Figure 43:
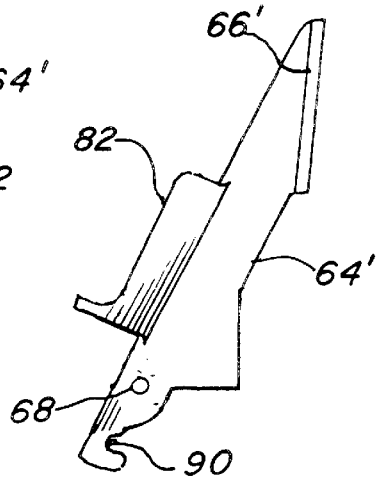
FIG. 43 is a right side view of the pivotal loading arm in the preferred embodiment, completely removed from the invention for clarity.
Figure 44:
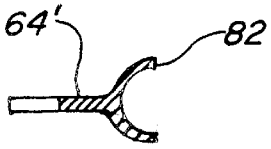
FIG. 44 is a cross-sectional view taken along lines 44—44 of FIG. 41.
Figure 45:
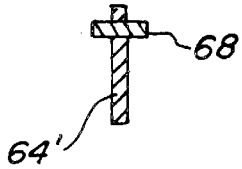
FIG. 45 is a cross-sectional view taken along lines 45—45 of FIG. 42.
Figure 46:
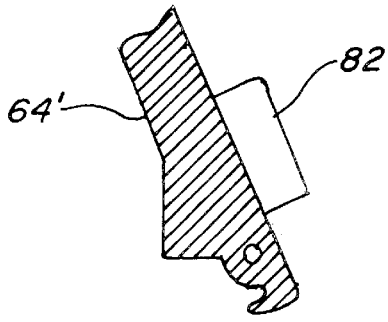
FIG. 46 is a cross-sectional view taken along lines 46—46 of FIG. 42.

Means for holding each loading lever 64' in an expanded open position prior to insertion of the cartridges into the moon clip 24 is in the form of extension spring means held in place between half slots 90 located in each lever. This arrangement permits the top portion of the lever 64' to be urged outwardly in an at rest position and expanding the spring means when the levers are manually squeezed together in pairs. The spring means is preferably an o-ring 92 however a garter spring or the like is also an acceptable alternate. FIG. 37 illustrates this arrangement in its operable condition and the o-ring 92 is shown separately in FIG. 39.

In operation individual cartridges are placed by hand into each of the loading levers radial cavity's 82 with the bullet end touching the bottom of the cavity. The loading levers 64' are pressed together in pairs by the operator forcing the groove in the cartridge case, just below the head, into the indentations of the moon clip 24 with a snapping action. As in the second embodiment the loaded clip may be removed with the operators thumb and forefinger.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A loading device for insertion of cartridges into a moon clip having a plurality of retaining notches comprising:

a body having a bottom for resting on a horizontal surface, post means on the body for holding a moon clip thereon, and a plurality of loading levers, pivotally attached to the body, in alignment with said moon clip retaining notches for urging the cartridges into the moon clip when the levers are manually compressed together in pairs.

2. The loading device for insertion of cartridges into a moon clip as recited in claim 1 wherein said post means further comprises an upstanding cylindrical post means in the center and a plurality of upright guides molded into a top portion of the base.

3. The loading device for insertion of cartridges into a moon clip as recited in claim 2 wherein said post means comprises an adapter sleeve disposed over the cylindrical post having a hexagonal or polygonal shape with a top portion having dimensions to receive a moon clip thereon.

4. The loading device for insertion of cartridges into a moon clip as recited in claim 3 wherein said adapter sleeve top portion includes a plurality of steps to accommodate different styles of moon clips.

5. The loading device for insertion of cartridges into a moon clip as recited in claim 1 wherein said loading levers further having an inwardly sloping radial cavity for retaining cartridges thereon.

6. The loading device for insertion of cartridges into a moon clip as recited in claim 5 further comprising means for holding said loading levers in an expanded open position permitting introduction of the cartridges into the inwardly sloping radial cavities prior to insertion of the cartridges into the moon clip.

7. The loading device for insertion of cartridges into a moon clip as recited in claim 6 wherein said means for holding said loading levers in an expanded open position comprising, extension spring means between each lever such that the lever top portion is urged outwardly in an at rest position and the spring means expand when the levers are manually squeezed together in pairs.

8. The loading device for insertion of cartridges into a moon clip as recited in claim 7 wherein said spring means is an o-ring.

9. The loading device for insertion of cartridges into a moon clip as recited in claim 1 wherein said post means, body and loading levers are injection molded thermoplastic.

10. The loading device for insertion of cartridges into a moon clip as recited in claim 1 further comprising:

said body having a plurality of inwardly sloping radial cavities that align with the moon clip cartridge retaining notches, said post means having a hexagonal shape and uprightly disposed within the body in a central position, said loading levers positioned in a middle portion of the sloping radial cavities for urging the cartridges into the moon clip retaining notches when manually compressed together in pairs, and means for holding said loading levers in an expanded open position permitting introduction of the cartridges into the radial cavities prior to insertion of the cartridges into the moon clip.

11. The loading device for insertion of cartridges into a moon clip as recited in claim 10 wherein said body is injection molded thermoplastic.

12. The loading device for insertion of cartridges into a moon clip as recited in claim 10 wherein said body comprises an upper casing and a base.

13. The loading device for insertion of cartridges into a moon clip as recited in claim 10 wherein said post means further comprise a hex head cap screw, having dimensions that permit the moon clip to be mounted thereupon, a coupling nut, having dimensions that are larger than the cap screw, said cap screw is completely threaded onto the coupling nut permitting the clip to rest on the coupling nut while being retaining by the cap screw.

14. The loading device for insertion of cartridges into a moon clip as recited in claim 10 further comprising, fastening means for attaching said hexagonal post to said body.

15. The loading device for insertion of cartridges into a moon clip as recited in claim 14 wherein said fastening means for attaching said hexagonal post to said body further comprising, a hex nut disposed within the body and said body restraining the nut from rotating.

16. The loading device for insertion of cartridges into a moon clip as recited in claim 10 wherein each of the loading levers further comprising a finger tab formed into an upper portion of the lever for manual manipulation and a pin disposed within the lever for pivotal attachment to the body.

17. The loading device for insertion of cartridges into a moon clip as recited in claim 10 wherein said means for holding said loading levers in an expanded open position further comprising a compression spring positioned between each lever and the body such that each lever is urged outwardly in an at rest position and the spring is further compressed when the levers are manually squeezed together in pairs.

18. The loading device for insertion of cartridges into a moon clip as recited in claim 10 further comprising at least one hex spacer positioned between the post and the body for height adjustment of the post to accommodate a specific cartridge length.

19. A loading device for insertion of cartridges into a moon clip having retaining notches comprising:

a body for resting on a horizontal surface, post means on the body for holding a moon clip thereon, and a plurality of loading levers, pivotally attached to the body, in alignment with said moon clip retaining notches for urging the cartridges into the moon clip when the levers are manually compressed together.

* * * * *